US009211990B2

(12) United States Patent
Kearney

(10) Patent No.: US 9,211,990 B2
(45) Date of Patent: Dec. 15, 2015

(54) DISPENSING PORT

(71) Applicant: William E. Kearney, Batavia, OH (US)

(72) Inventor: William E. Kearney, Batavia, OH (US)

( * ) Notice: Subject to any disclaimer, the term of this patent is extended or adjusted under 35 U.S.C. 154(b) by 0 days.

(21) Appl. No.: 13/837,574

(22) Filed: Mar. 15, 2013

(65) Prior Publication Data

US 2014/0209606 A1 Jul. 31, 2014

Related U.S. Application Data

(60) Provisional application No. 61/758,695, filed on Jan. 30, 2013.

(51) Int. Cl.

| | |
|---|---|
| ***B65D 41/32*** | (2006.01) |
| ***B65D 75/58*** | (2006.01) |
| ***B65B 61/18*** | (2006.01) |
| ***B65B 9/08*** | (2012.01) |

(52) U.S. Cl.

CPC ..... *B65D 75/5838* (2013.01); *B65B 9/08* (2013.01); *B65B 61/18* (2013.01)

(58) Field of Classification Search

CPC ..... B65D 65/02; B65D 5/745; B65D 77/065; B65D 75/5811; B65D 75/5855; B65D 75/5894; B65D 31/02; B65D 17/168; B65D 75/5838; B65B 9/08; B65B 61/18

USPC ..... 220/266

See application file for complete search history.

(56) References Cited

U.S. PATENT DOCUMENTS

| | | | | |
|---|---|---|---|---|
| 2,888,159 | A * | 5/1959 | Fields | 215/230 |
| 2,991,000 | A * | 7/1961 | Spees | 383/205 |
| 3,178,063 | A * | 4/1965 | Cox, Jr. | 222/105 |
| 3,256,941 | A | 6/1966 | Rivman | |
| 3,278,085 | A | 10/1966 | Brown | |
| 3,527,400 | A * | 9/1970 | Whipperman et al. | 206/363 |
| 4,007,838 | A | 2/1977 | Awad | |
| 4,372,460 | A | 2/1983 | Brochman et al. | |
| 4,553,693 | A * | 11/1985 | Terajima et al. | 229/75 |
| 4,595,116 | A | 6/1986 | Carlsson | |
| 4,735,335 | A * | 4/1988 | Torterotot | 220/270 |
| 5,004,111 | A | 4/1991 | McCarthy | |
| 5,310,262 | A * | 5/1994 | Robison et al. | 383/205 |
| 5,408,807 | A | 4/1995 | Lane et al. | |
| 5,452,849 | A | 9/1995 | Schramer et al. | |
| 5,514,442 | A | 5/1996 | Galda et al. | |
| 5,632,416 | A | 5/1997 | Lane et al. | |
| 6,106,153 | A * | 8/2000 | Toshima | 383/204 |
| 6,254,273 | B1 | 7/2001 | Galomb et al. | |
| 6,315,448 | B1 | 11/2001 | Thrall | |
| 6,328,203 | B1 | 12/2001 | Tedford, Jr. | |

(Continued)

OTHER PUBLICATIONS

International Search Report and Written Opinion, PCT/US2014/013731, Kearney, William E., dated May 22, 2014, 7 pages.

*Primary Examiner* — Anthony Stashick

*Assistant Examiner* — James M Van Buskirk

(74) *Attorney, Agent, or Firm* — Hasse & Nesbitt LLC; Daniel F. Nesbitt

(57) ABSTRACT

A sealed dispensing port in a wall of a container or package, the wall including an outer sheet having a formed aperture there through, and an inner comprising a seal portion registered with the aperture, and a release cover that includes a seal portion over the aperture that irreleasably attaches through the aperture to the seal portion of the inner sheet to form a seal. When the release cover is pulled from over the aperture, the seal is removed to form a dispensing port.

9 Claims, 6 Drawing Sheets

(56) References Cited

U.S. PATENT DOCUMENTS

| | | | | |
|---|---|---|---|---|
| 6,415,939 | B1 | 7/2002 | Redmond | |
| 6,783,030 | B2 | 8/2004 | Redmond | |
| 6,929,400 | B2 | 8/2005 | Razeti et al. | |
| 6,959,832 | B1 | 11/2005 | Sawada et al. | |
| 7,565,987 | B2 | 7/2009 | Bauer | |
| 7,681,732 | B2 | 3/2010 | Moehlenbrock et al. | |
| 8,109,385 | B2 * | 2/2012 | Wiggins et al. | 206/221 |
| 2001/0030192 | A1 | 10/2001 | Redmond | |
| 2010/0320206 | A1 | 12/2010 | Caldwell et al. | |
| 2013/0015092 | A1 * | 1/2013 | Suzuki et al. | 206/497 |
| 2013/0020324 | A1 * | 1/2013 | Thorstensen-Woll et al. | 220/270 |

* cited by examiner

DISPENSING PORT

CROSS REFERENCE TO RELATED APPLICATIONS

This application claims the benefit of U.S. Provisional application 61/758,695, filed Jan. 30, 2013, the disclosure of which is incorporated by reference in its entirety.

BACKGROUND OF THE INVENTION

A pouch-style package is used universally for a broad spectrum of products, ranging from ketchup and other condiments to health and beauty aids, as well as medical products, household and automotive cleaning products, and other foods and technical products. These pouches are typically made of foil/plastic laminates, which may have specific properties including oxygen barriers, moisture barriers, varying sealing and/or softening temperatures and printable surfaces.

SUMMARY OF THE INVENTION

The invention provides a sealed dispensing port in a wall of a container or package, the wall including an outer sheet having a formed aperture there through, and an inner comprising a seal portion registered with the aperture, and a release cover that includes a seal portion over the aperture that irreleasably attaches through the aperture to the seal portion of the inner sheet to form a removable seal.

The invention also provides a sealed dispensing port in a flexible wall of a package, the flexible wall comprising an inner sheet and an outer sheet that has a formed aperture that exposes an exposed portion of the inner sheet, and a release cover that includes a seal portion that irreleasably attaches through the aperture to the exposed portion of the inner sheet to form a removable seal.

The invention further provides a sealed dispensing port in a flexible wall of a package containing a flowable product, the flexible wall comprising an inner sheet and an outer sheet, the flexible wall having a formed aperture therethrough, a seal patch sealingly attached to an inside surface of the inner sheet over and surrounding the aperture, and a release cover that includes a seal portion that irreleasably attaches through the aperture to an exposed portion of the seal patch to form a removable seal.

The invention also provides a sealed package for containing and dispensing a flowable product, the sealed package comprising a first wall and a confronting second wall, the first wall comprising an outer sheet and an inner sheet, wherein the outer sheet of the first wall has a formed aperture that exposes an exposed of the inner sheet, and a release cover that includes a seal portion that irreleasably attaches through the aperture to the exposed portion of the inner sheet of the first wall to form a removable seal.

The invention additionally provides a sealed package for containing and dispensing a flowable product comprising a first wall and a confronting second wall, the first wall comprising an outer sheet and an inner sheet, wherein the first wall has an aperture therethrough, a seal patch sealingly attached to an inside surface of the inner sheet of the first wall over and surrounding the aperture, and a release cover that includes a seal portion that irreleasably attaches through the aperture to an exposed portion of the seal patch to form a removable seal.

Further, the invention provides a method of forming a sealed dispensing port in a flexible wall of a package, comprising the steps of: a) providing an outer sheet having a formed aperture, b) laminating an inner sheet to an inner surface of the outer sheet to expose a portion of the inner sheet through the aperture of the outer sheet, c) positioning a release cover onto the outer sheet that covers the aperture, and d) attaching irreleasably through the aperture a seal portion of the release cover disposed over the aperture to the exposed portion of the inner sheet to form a removable seal.

The invention also provides a method of forming a sealed dispensing port in a flexible wall of a package, comprising the steps of: a) providing flexible wall comprising an inner sheet and an outer sheet, b) forming an aperture through the flexible wall, c) positioning a seal patch to an inside surface f the inner sheet over and surrounding the aperture, d) positioning a release cover onto the outer sheet that surrounds the aperture, and e) attaching irreleasably through the aperture a seal portion of the release cover disposed over the aperture to an exposed portion of the seal patch, and sealing the seal patch to the inner sheet surrounding the aperture, to form a seal across the aperture.

DETAILED DESCRIPTION OF THE INVENTION

The invention provides a sealed dispensing port for a walled container. The container can contain a flowable liquid or gel composition, or a flowable powder or particulate, which is dispensed from the container through the dispensing port when opened. The wall of the container can be either flexible, as in the case of a film, sheet, or thin-walled material, or a more rigid and resilient wall.

Figures 1, 2, 3:
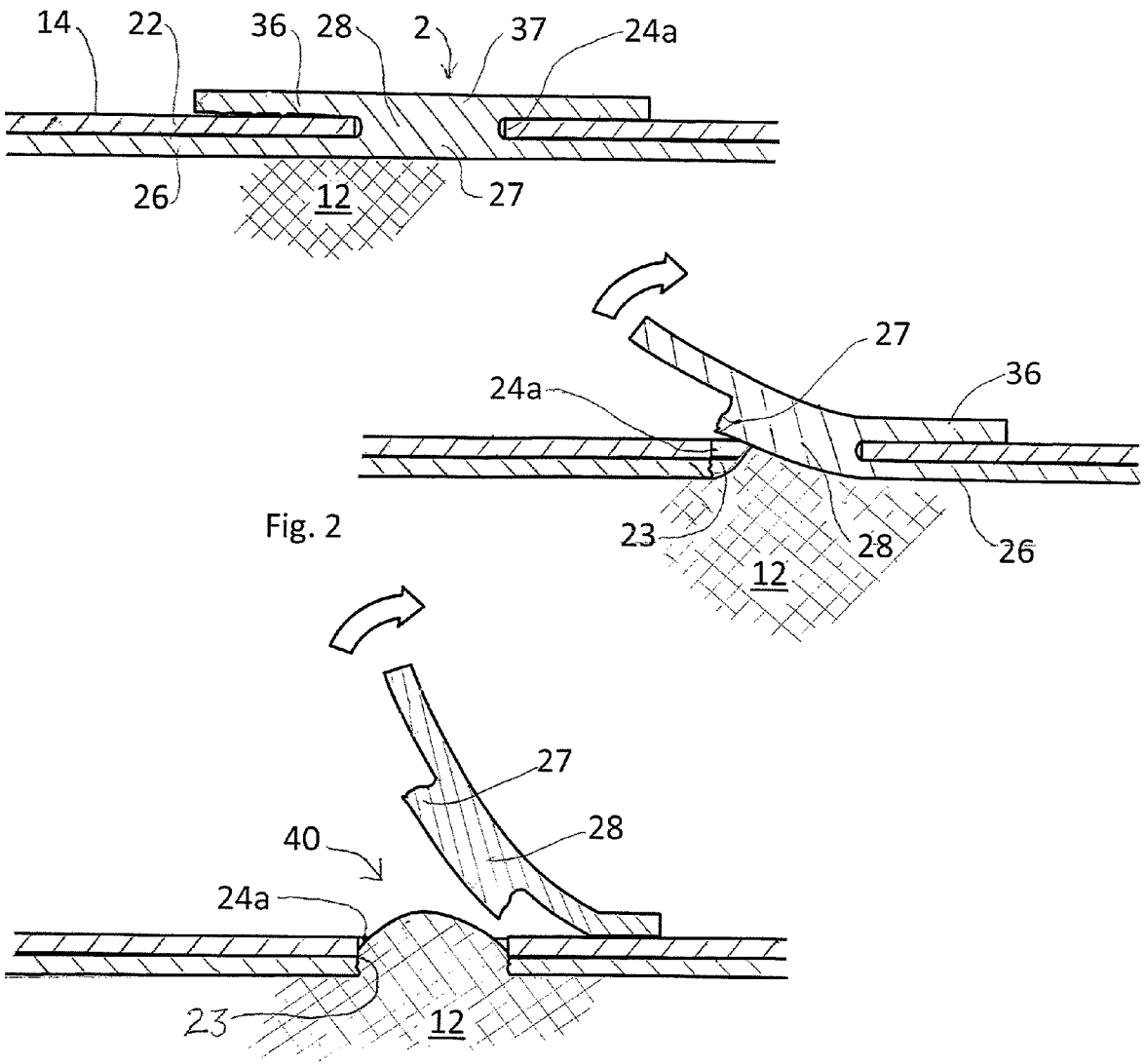
FIG. 1 shows a sealed dispensing port of the invention.
FIG. 2 shows the sealed dispensing port of FIG. 1 at a first condition of the removal of the seal.
FIG. 3 shows the sealed dispensing port of FIG. 1 at a second condition of the removal of the seal.

FIG. 1 illustrates a sealed dispensing port 2 in a flexible wall 14 of a container or package (not shown). The wall 14 includes an outer layer shown as flexible outer sheet 22 that has a aperture 24 formed through its thickness, and an inner layer shown as flexible inner sheet 26 that is laminated to an inside surface of the outer sheet 22. The inner sheet 26 includes a seal portion 27 that is registered with the aperture 24 in the outer sheet. A release cover 36, in the form of a sheet or strip of a flexible material, is disposed over the outer sheet 22 surrounding the aperture 24, and includes a seal portion 37 over the aperture 24. The seal portion of the release cover 36 is formed as an irreleasable attachment through the aperture 24 to the seal portion 27 of the inner sheet 26 to form a removable seal 28 that is integral with, and consisting of, the seal portion 37 of the release cover and the seal portion 27 of the inner sheet 26.

Typically, the material of the release cover 36 and the material of the seal portion 27 are thermoplastic materials that adhere to one another under conditions of elevated temperature and pressure. In a typical application, the material is a thermoplastic. Thermoplastic materials can be fused or welded by any well known means, including hot gas welding, heat sealing, contact welding, high frequency welding, ultrasonic welding, friction welding, laser welding, and solvent welding. Pressure can be used instead of, or in combination with, elevated temperature to fuse or welds the thermoplastic materials together.

The remaining portion of the release cover 36 can be releasable attached to the outer sheet surrounding the aperture 24, or can be loose or unattached thereto. The releasable attachment can be formed materially, such as be a releasable adhesion, or mechanically such as by crimping.

The sealed dispensing port 2 can be opened by removing the removable seal 28. As shown in FIGS. 2 and 3, as the release cover 36 is pulled out and away from the aperture 24, the integral removable seal 28, including the seal portion 27 of the inner sheet 26, ruptures and tears along the perimeter 23 of the aperture 24, and eventually completely separates from the inner sheet 26, leaving an outlet 40.

Figure 4:
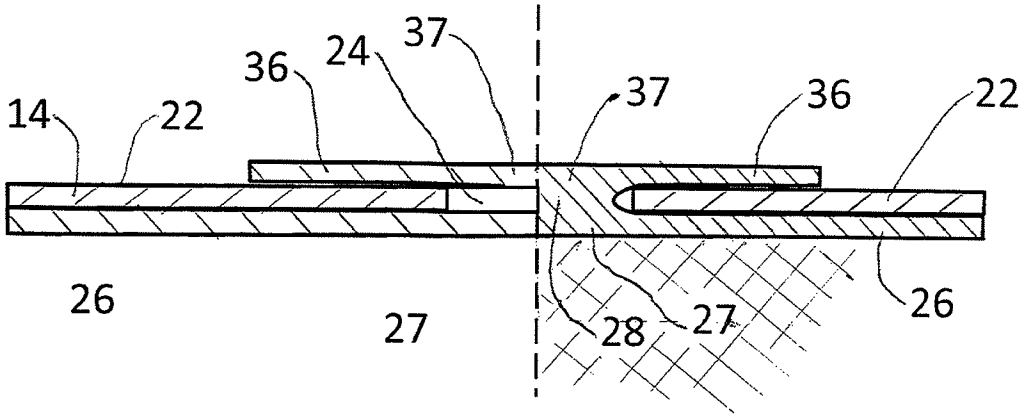
FIG. 4 shows a first embodiment of a sealed dispensing port, including a left hand side that shows the elements that comprise the seal, and a right hand side that shows the fusing of the elements into the seal.

In a first embodiment of a sealed dispensing port shown in the left hand portion of FIG. 4, inner sheet 26 is a continuous sheet of material that covers the entire inner surface of the outer sheet 22, and the seal portion 27 is an integral portion of the inner sheet 26. It is understood that the inner sheet 26 can include one, two of more layers of materials, and that the outer sheet can include one, two of more layers of materials. In an embodiment, the aperture is formed into the outer sheet 22 prior to laminating the lower sheet 26 to the outer sheet 22 to form the continuous flexible wall 14. The inner sheet 26 as illustrated is disposed on the underside of the outer sheet 22, with the integral seal portion 27 exposed from the upper side through the aperture 24. The release cover 36 is positioned on the upper side of the outer sheet 22, with the seal portion 37 in registry with the aperture 24.

Following a process that melts or fuses together the seal portions 27,37 of inner sheet 26 and the release cover 36, as shown in the right hand portion of FIG. 4, a seal 28 is formed through the aperture 24. A pressure and fluid transmission sealing of the aperture 24 from the inner side of the wall 14 is provided by the integral inner sheet 22. The seal 28 is removable and separable from the remaining portion of the inner sheet 26 by tearing away with the release cover, as described above.

Figure 5:
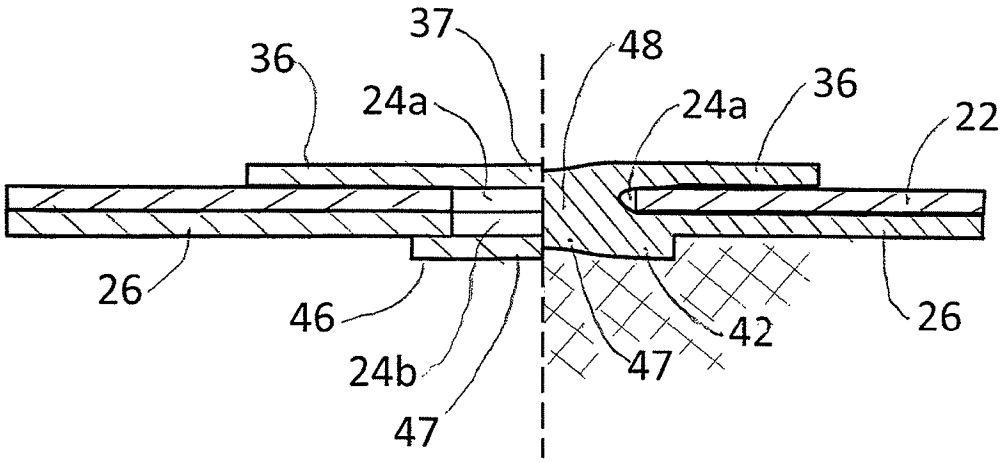
FIG. 5 shows a second embodiment of a sealed dispensing port, including a left hand side that shows the elements that comprise the seal, and a right hand side that shows the fusing of the elements into the seal.

In a second embodiment sealed dispensing port shown in the left hand portion of FIG. 5, an aperture 24 is formed in the flexible wall 14 through both the outer sheet 22 (aperture 24*a*) and the inner sheet 26 (aperture 24*b*). The seal portion 47 is a portion of a separate strip or layer of material shown as a seal patch 46 that is positioned on the underside of the inner sheet 22, that surrounds and covers aperture 24*b* formed in the inner sheet 26. A release cover 36 is positioned on the upper side of the upper sheet 22, with the seal portion 37 in registry with the aperture 24*a* formed in the upper sheet 22.

Following a process that melts or fuses together the seal portions 47,37 of the seal patch 46 and the release cover 36, as shown in the right hand portion of FIG. 5, a seal 48 is formed through the aperture 24. A portion of the inner sheet 26 that surrounds the aperture 24*b*, may also be melted and fused into the seal 48. Typically the release cover 36, seal patch 46, and the inner sheet 26 are fusably or meltably compatible thermoplastics, and can be the same type of thermoplastic material, such that sealing of the aperture 24 from the inner side of the wall 14 is provided by the seal patch 46 sealed to the inner sheet 26. The sealing can include a pressure sealing and a fluid-transmission sealing. The seal 48 is removable and separable from the remaining portion of the inner sheet 26 by tearing away with the release cover 36, as described above.

Figure 7:
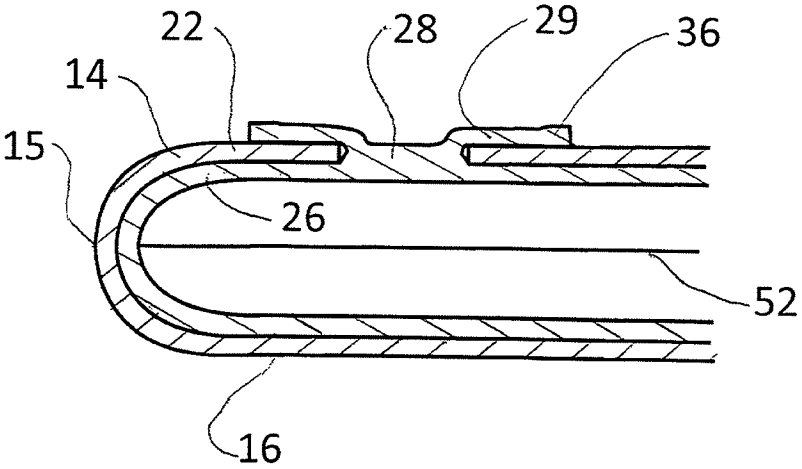
FIG. 7 shows a cross section of the sealed dispensing port of FIG. 6 taken through line 7-7.
Figure 6:
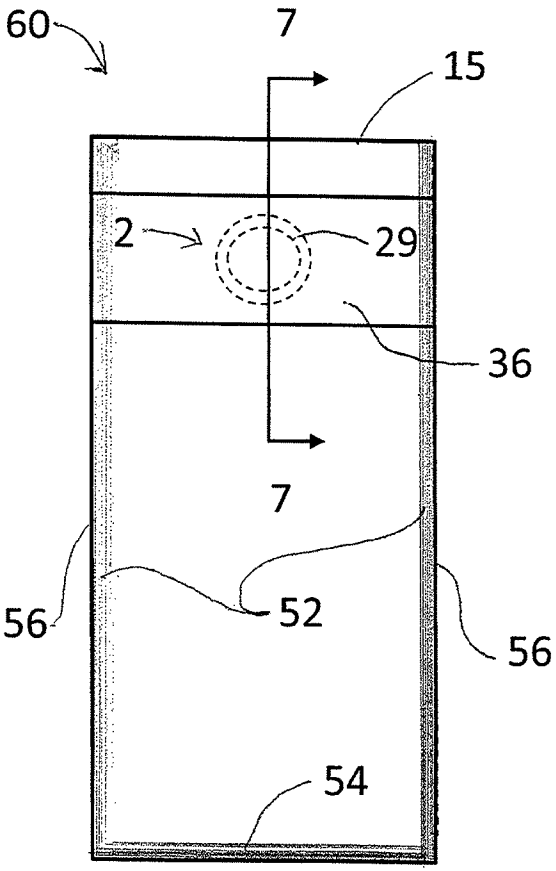
FIG. 6 shows a sealed product pouch having a sealed dispensing port.

FIG. 6 illustrates a sealed dispensing port 2 formed in a flexible wall 14 of a sealed container or package 60. FIG. 7 is a cross section view through the sealed package 60 containing a flowable product (not shown). An upper wall 14 and a lower wall 16 provide a pair of confronting flexible walls that are sealed around their periphery to form the cavity that contains the flowable product. The flexible wall 14 comprises an inner sheet 26 and an outer sheet 22, the flexible wall 14 having a formed aperture 24 therethrough, and a seal 28 formed through the aperture 24. The seal 28 is formed by the fusing of the release cover 36 to a portion of the inner sheet 26 exposed through the aperture 24.

Figure 8:
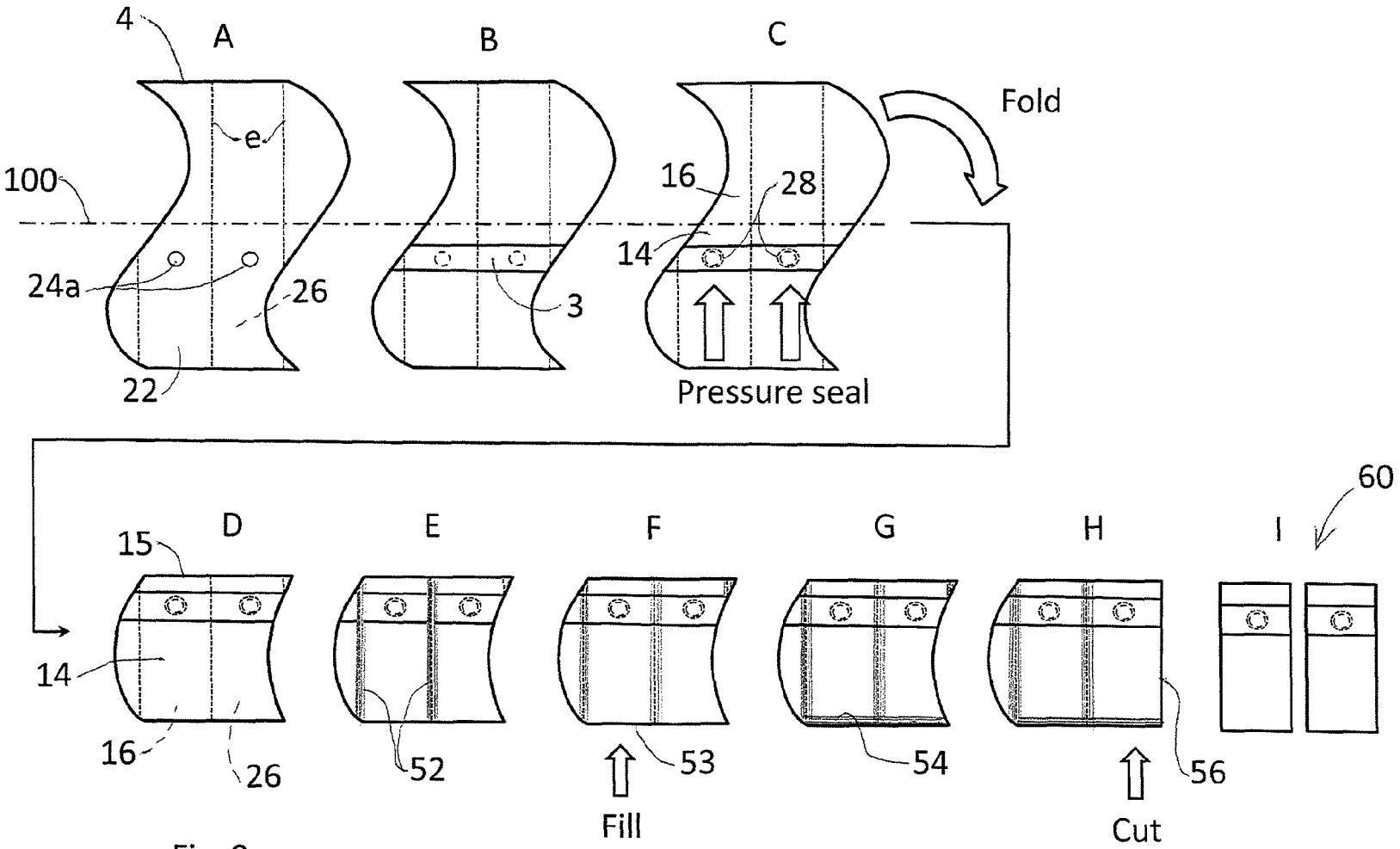
FIG. 8 illustrates a first method of forming a sealed product pouch having a sealed dispensing port.

FIG. 8 shows a schematic of a method of forming a flexible wall having a sealed dispensing port, and a pouch package formed from the flexible wall material. Stage A illustrates a portion of flexible wall material 4 that is unwound from a roll of the material in a well known manner (not shown). The flexible wall material 4 is centered longitudinally along a centerline 100, and includes an outer sheet 22 laminated to an inner sheet 26. An aperture 24*a* has formed into a portion of the outer sheet 22 at spaced apart locations along the length of the flexible wall 4. FIG. 8 shows laterally-extending imaginary lines e that are spaced apart along the length of the flexible wall material, to identify where the flexible wall material will later be separated when forming individual pouches. The aperture 24*a* is located on one side of the centerline 100, shown centered between the lateral lines e.

At stage B, a strip of a film material 3 is applied over the line of apertures 24*a*, typically continuously from a roll. The strip of film material 3 forms the release cover 36 in the final package. At stage C, the portions of inner sheet 26 exposed through aperture 24*a* are fused to the film material 3, typically with pressure and/or heat to form the seals 28. The upper half of the flexible wall material 4 is then folded under the lower half along the centerline 100, as shown at stage D, to provide confronting sidewalls 14 and 16 joined by a fold 15. The strip of film material 3 remains on the outside of the outer sheet 22. In stage E, the confronting sidewalls are joined by a lateral pressure and/or heat seal 52 along the lines e to segregate the space between the two confronting walls into distinct package cavities.

At stage F, the package cavities defined by the lateral seals 52 are filled with a product through the remaining opening between the confronting sidewalls 14 and 16. At stage G, a longitudinal seal 54 is formed along the opening to seal closed the package cavities. Stage H shows the connected sealed packages being separated with a lateral cut along and within the lateral seals 56, to form at stage I the individual, sealed product pouches 60.

Figure 9:
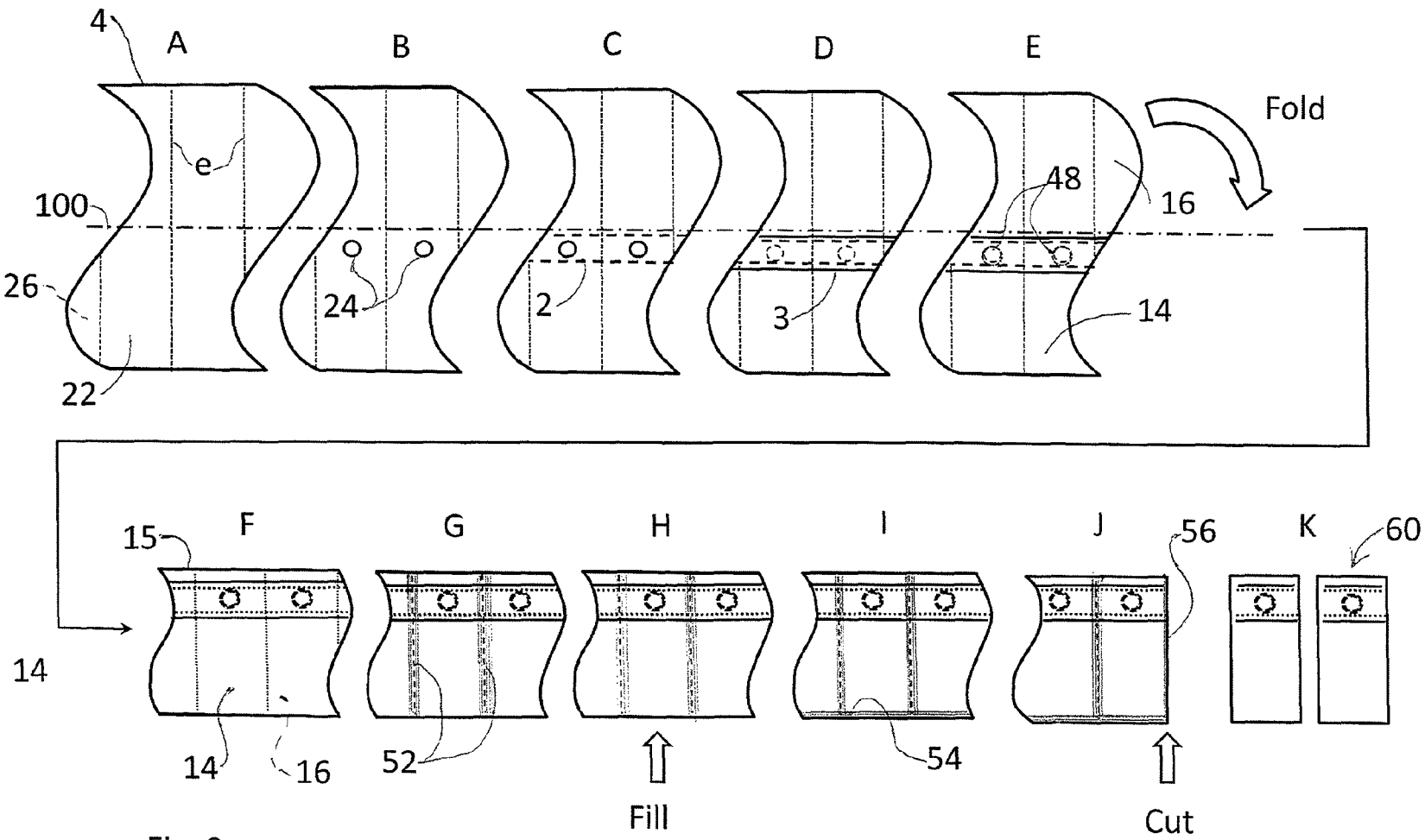
FIG. 9 illustrates a second method of forming a sealed product pouch having a sealed dispensing port.

It can be understood that a modified method can be used to form a product pouch having a sealed dispensing port of the second embodiment described herein above. In this second embodiment of the method, illustrated in FIG. 9, starting in stage A with a continuous film of flexible wall material 4. At stage B, apertures 24 are formed through both layers 22 and 26 of the flexible wall material 4 at spaced apart locations along the length of the flexible wall material 4, along one side of the centerline 100 and centered between the lateral lines e. At stage C, a strip of a seal film material 2 is provided, typically continuously from a roll, and disposed on the underside of the film material 4, over the inner layer 26, and covering the line of apertures 24. Typically, the strip of the seal film material is sealed over a substantial portion of, and more typically the entire surface of, the inner surface of the inner layer 26. The strip of seal film material 2 forms the seal patch 46 in the final package. At stage D, a second strip of a film material 3 is disposed on the topside of the film material 4, covering the line of apertures 24, typically continuously from a roll. The strip of film material 3 forms the release cover 36 in the final package. At stage E, the portions of seal film material 2 exposed through aperture 24 are fused to the film material 3, typically with pressure and/or heat to form the seals 48. The upper half of the flexible wall material 4 is then folded under the lower half along the centerline 100, as shown at stage F, to provide confronting sidewalls 14 and 16 joined by a fold 15. The strip of film material 3 remains on the outside of the outer sheet 22. In stage G, the confronting sidewalls are joined by a lateral pressure and/or heat seals 52 along the lines e to segregate the space between the two confronting walls into distinct package cavities.

At stage H, the package cavities defined by the lateral seals 52 are filled with a product through the remaining opening between the confronting sidewalls 14 and 16. At stage I, a longitudinal seal 54 is formed along the opening to seal closed the package cavities. Stage J shows the connected sealed packages being separated with a lateral cut along and within the lateral seals 56, to form at stage K the individual, sealed product pouches 60.

It can be understood that the strip of seal patch 46 material can be a strip or patch of material that is disposed over and surrounding the aperture, though not continuously across the width of the flexible walls. Similarly, the release patch 36 material a strip or patch of material that is disposed over and surrounding the aperture, though not continuously across the width of the flexible walls. Either strip of material can be applied transverse to the width of the package.

It can be understood that a modified method can be used to form a product pouch as described above from two separate sheets of flexible wall material, with one sheet underlying the other in registry, where a further seal along the top edge of the confronting sidewalls replaces the fold 15.

Figure 10:
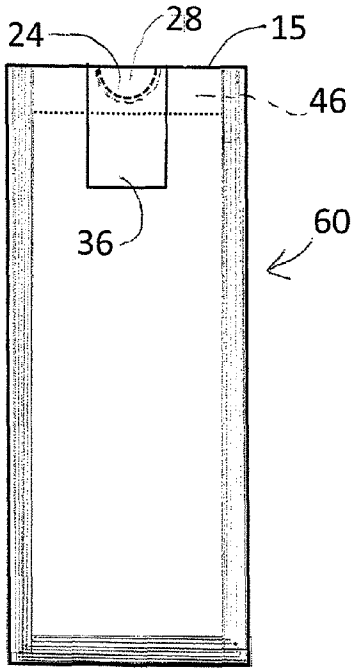
FIG. 10 shows another embodiment of a sealed product pouch having a sealed dispensing port.

It can also be understood that the location of the aperture 24 can be moved laterally closer to the centerline 100, or further away, including to the geometric center of the formed pouch, or longitudinally toward one long side edge of the pouch, as the need or pouch usage may require. The aperture may also be disposed along the centerline 100, and the resulting fold 15 in the flexible sidewall. In this embodiment, the release patch 36 may advantageously be applied transverse to the width of the package, on both sides of the fold line. This is illustrated in FIG. 10.

An example of a flexible wall material, including at least a first, inner layer and a second layer, is a multi-ply film material that includes the following film layers: an inner-most layer of linear low density polyethylene (LLDPE); a next adjacent layer of ethylene acrylic acid copolymer (EAA); a next adjacent layer of aluminum; a next adjacent layer of low density polyethylene (LDPE); and a layer of coated polyester primer. The overall thickness of the flexible wall material is about 0.2-3 mil (thousands of an inch). The typical thickness of any one layer is about 0.2-1.5 mil. The inner-most layer is typically about 0.5-2.0 mil. Examples of the flexible wall material are disclosed in U.S. Pat. Nos. 6,783,030 and 6,415,939, the entire disclosures of which are incorporated by reference.

The seal patch material is typically LLDPE or LDPE, and can be any material that is can fuse with the inner sheet 26. The seal patch material can be transparent, translucent, or opaque, and can be neutral or colored. For example, a white or other colored material can be used to signal to the user, when the removable seal is pulled away, since the seal patch material has been fused to the release cover.

The release cover material can be the same or similar to the materials of the flexible wall material, or the seal patch material. Typically the release cover material is a transparent film that allows the user to see the aperture through the film.

Figure 11:
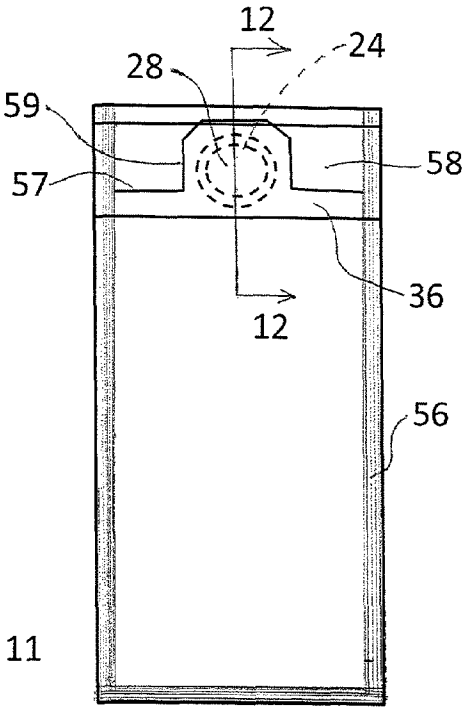
FIG. 11 shows another embodiment of a sealed product pouch having a restricted dispensing cavity.
Figure 12:
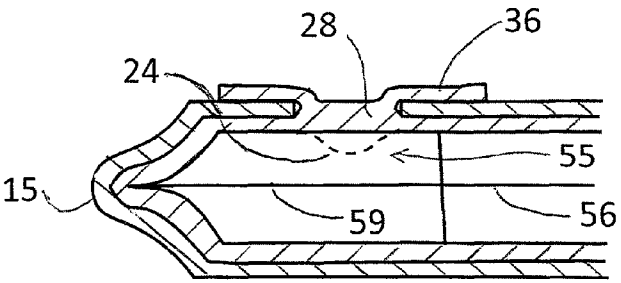
FIG. 12 shows the embodiment of the sealed product pouch of FIG. 11 taken through line 12-12.

In another embodiment of the invention, a portion of the first flexible wall 14 surrounding the aperture can be sealed to a confronting portion of the second flexible wall 16. An example is shown in FIGS. 11 and 12, wherein the aperture is formed near the fold 15, and a further seal 58 is formed proximate the fold 15, and extending from near the fold 15 to a seal edge lines 57 and 59 along both sides of the aperture 24. In this seal area, the inner sheets 22 of the confronting walls 14 and 16 are fused together. The interior cavity containing the product to be dispensed extends into a restricted dispensing cavity 55 between the extensions of seal 58 and proximate the aperture 24. Upon opening of the sealed aperture, the product is directed out through the restricted dispensing cavity 55.

The outer sheet 22 can include a layer on which a graphic design or message can be printed, as for a consumer product's copy. In addition, the release cover 36 can include a layer on which a graphic design or message can be printed, and that the graphic design or message can be matched with that of the outer sheet 22.

I claim:

1. A sealed dispensing port in a wall of a container or package, the wall including an outer sheet and an inner sheet having an aperture through both the outer sheet and inner sheet of the wall, a separate seal patch sealingly fused to the inner sheet over and surrounding the aperture, the separate seal patch comprising a seal portion registered with the aperture, and a release cover that includes a seal portion over the aperture that is irreleasably fused through the aperture to the seal portion of the separate seal patch to form a removable seal, wherein the seal portion of the separate seal patch ruptures and tears away with the seal portion of the release cover when the release cover releases from the outer sheet and pulls away from over the aperture, to form an outlet, and wherein the seal patch is a colored material and colored seal portion of the seal patch remains fused to the release cover, wherein the wall comprises a single flexible sheet that is folded over to form a first wall having the aperture and a second wall joined along a folded edge, wherein the first wall and second wall are sealed along a perimeter to form a cavity that contains a flowable product, wherein the aperture is formed in the first wall near the fold, and further including a pair of seal lines between the first wall and the second wall formed near the fold and extending along the lateral sides of the aperture to form a restricted dispensing cavity between the pair of seal lines and in fluid communication with the cavity.

2. A sealed dispensing port in a flexible wall of a package containing a flowable product, the flexible wall comprising an inner sheet and an outer sheet, the flexible wall including a first wall having a formed aperture therethrough and a second wall sealed along a perimeter to form a cavity that contains the flowable product, a seal patch sealingly attached to an inside surface of the inner sheet of the first wall over and surrounding the aperture, and a release cover that includes a seal portion that is irreleasably fused through the aperture to an exposed portion of the seal patch to form a removable seal, wherein the exposed portion of the seal patch ruptures and tears away with the seal portion of the release cover when the release cover pulls away from over the aperture, to form an outlet through the aperture, wherein the aperture is formed near a top edge of the first wall, and further including a pair of seal lines between the first wall and the second wall formed near the top edge and extending along the lateral sides of the aperture to form a restricted dispensing cavity between the pair of seal lines and in fluid communication with the cavity.

3. The sealed dispensing port according to claim 2 wherein the material of the release cover and of the seal patch is the same as the material of the inner sheet.

4. The sealed dispensing port according to claim 2 wherein the seal patch is a colored material.

5. The sealed dispensing port according to claim 4 wherein the seal patch is a white colored material.

6. A sealed package for containing and dispensing a flowable product comprising a first wall and a confronting second wall, the first wall and the second wall comprising an outer sheet and an inner sheet, wherein the first wall has an aperture therethrough, a seal patch sealingly attached to an inside surface of the inner sheet of the first wall over and surrounding the aperture, and a release cover that includes a seal portion that is irreleasably fused through the aperture to an exposed portion of the seal patch to form a removable seal, wherein the exposed portion of the seal patch ruptures and tears away with the seal portion of the release cover when the release cover pulls away from over the aperture, to form an outlet through the aperture, wherein the first wall and the second wall are formed from a single flexible sheet that is folded over and sealed together around a portion of a perimeter to define a cavity that contains the flowable product, with the remaining unsealed portion of the perimeter forming a folded edge, wherein the aperture is along the folded edge, wherein the aperture is formed in the first wall near the fold, and further including a pair of seal lines between the first wall and the second wall formed near the fold and extending along the lateral sides of the aperture to form a restricted dispensing cavity between the pair of seal lines and in fluid communication with the cavity.

7. The sealed package according to claim 6, wherein the outer sheet comprises at least two film layers.

8. The sealed package according to claim 6, wherein the aperture is circular.

9. The sealed package according to claim 6 wherein the aperture is in the folded edge.

* * * * *